US005384185A

United States Patent [19]

Bovenschen et al.

[11] Patent Number: 5,384,185

[45] Date of Patent: Jan. 24, 1995

[54] CONDUCTING REINFORCED PLASTICS

[75] Inventors: Dirk A. Bovenschen, Renswoude; Rudolf G. Goossens, Lichtenvoorde, both of Netherlands

[73] Assignee: Lantor B.V., Netherlands

[21] Appl. No.: 33,386

[22] Filed: Mar. 19, 1993

[30] Foreign Application Priority Data

Mar. 20, 1992 [EP] European Pat. Off. ..... 92200816

[51] Int. Cl.[6] ..... B32B 5/02

[52] U.S. Cl. ..... 428/235; 428/85; 428/116; 428/131; 428/137; 428/138; 428/234; 428/251; 428/252; 428/253; 428/284; 428/285; 428/287; 428/299; 428/300; 428/304.4; 428/417; 428/418; 428/408; 428/902

[58] Field of Search ..... 428/85, 92, 93, 97, 428/116, 131, 137, 138, 285, 300, 253, 234, 251, 252, 235, 287, 299, 304.4, 417, 418, 284, 408, 902

[56] References Cited

U.S. PATENT DOCUMENTS

| | | | |
|---|---|---|---|
| 4,808,465 | 2/1989 | Vane | 428/285 |
| 4,983,452 | 1/1991 | Daimon et al. | 428/287 |

FOREIGN PATENT DOCUMENTS

| | | | |
|---|---|---|---|
| 0090151A1 | 10/1983 | European Pat. Off. . | |
| 0323642A3 | 7/1989 | European Pat. Off. . | |
| 2102087 | 7/1972 | Germany | 428/300 |
| 64000796 | 1/1989 | Japan . | |
| 3262199 | 11/1991 | Japan . | |
| 3274140 | 12/1991 | Japan . | |

*Primary Examiner*—James J. Bell

*Attorney, Agent, or Firm*—Peter L. Michaelson; Edward M. Fink

[57] ABSTRACT

The invention relates to the use of an assembly comprising at least one non-conductive or substantially non-conductive carrier material and at least one conductive fiber web which has been provided on at least one side of the carrier material, with fibers of the conductive web having been brought into electrically conductive contact, through the carrier material, with the other side of the carrier.

16 Claims, No Drawings

CONDUCTING REINFORCED PLASTICS

The present invention relates to the lowering of the electrical resistance of fibre-reinforced plastics by incorporating conductive fibres in these plastics.

The use of plastic materials for storage tanks for inflammable materials and for housings of electronic apparatus has boomed, inter alia on account of the good corrosion resistance and the minor weight of plastics.

However, a problem that is often encountered here is that electrostatic charging can occur owing to the high electrical resistance.

Discharge can be accompanied by sparks, which involves the risk of explosion. The surface resistivity of (fibre-reinforced) plastics is generally at least $10^{14}$ Ω#. No electrostatic charging is to be expected if the surface resistivity is $\leqq 10^9$ Ω# (measured according to VDE 0303 part 3) and the volume resistivity is $\leqq 10^6$ Ω·cm (DIN 51953).

Combustible gas, vapour and dry matter/air mixtures can be ignited by the discharge phenomena (sparkover) of electrostatic charges. The minimum required ignition energy determines which class the explosive mixtures are classified into. Three classes are distinguished, viz.:

Class 1—ignition energy $\geqq 0.30$ mWs.

Dry matter/air mixtures require between 10 and 100 mWs.

Class 2—ignition energy 0.025–0.30 mWs.

Vapours of solvents and petrol.

Class 3—ignition energy $\leqq 0.025$ mWs.

Hydrogen, acetylene.

The possibility of rendering plastics electrically conductive by adding conductive additives is generally known. By adding to the plastic such conductive additives as graphite, carbon, aluminum, silver and copper powder, the desired conductive properties are obtained. The use of short metal fibres and short metallized fibres is also known. An article in "Polymer Engineering and Science", December 1977, Vol. 17, No. 12, titled "Conductive Polymeric Compositions" mentions the use of conductive fibres. In that article it is indicated that fibrous conductors are significantly better than powders, flakes and beads. The article is limited to conductive particles and fibres having a maximum aspect ratio of 35:1. The term 'aspect ratio' refers to the ratio between the length and the diameter of a particle.

The use of short conductive fibres, however, is an expensive affair in connection with the amount which is required to obtain the desired effect, viz. obtaining a conductive network. This requires that up to about 40 wt. % of material be added to the plastics. The same applies to the use of metal powders. Moreover, during the injection of resin in which conductive additives have been dispersed (RTM technique), the filtering out of these materials by the reinforcement presents a problem. Also, the mechanical properties of the finished product are influenced negatively by these "fillers". In spite of the fact that electrically conductive plastics have long been known, the use thereof for many applications has been limited by the negative economic, mechanical and processing aspects.

Housings of electronic apparatus are typically required to shield any electromagnetic radiation. In practice, this shield is often obtained by arranging a shielding material in the interior of the housing. The use of a plastics material for the housing that has inherently shielding properties typically meets with the objection that obtaining the shielding properties renders the material so expensive that the use thereof is prohibitive or the properties thereof are so poor that the material does not enable proper use.

One object of the present invention is to provide a system for providing plastics with electrically conductive properties, so that they are suitable for use in the fields described hereinabove.

The invention relates to the use of an assembly comprising at least one non-conductive or substantially non-conductive carrier material and at least one conductive fibre web which has been provided on at least one side of the carrier material, with fibres of the conductive web having been brought into electrically conductive contact, through the carrier material, with the other side of the carrier material, for making a reinforced plastics material.

The invention also relates to a plastics article comprising a matrix resin reinforced with an assembly comprising at least one non-conductive or substantially non-conductive carrier material and at least one fibre web which has been provided on at least one side of the carrier material, with fibres of the conductive web having been brought into electrically conductive contact, through the carrier material, with the other side of the carrier material.

Surprisingly, it has been found that by adapting the existing reinforcement of plastics and more in particular of thermosetting plastics, such as polyester resins and epoxy resins, a sufficient conduction can be obtained while maintaining the good material properties. This adjustment of the reinforcement amounts to the provision of a conductive fibre web on the normally used carrier material, with the fibres being arranged through the base material, for instance by needling. In this way a conduction is obtained throughout the entire material. The reinforced plastics material so produced thereby acquires a so-called continuity conductivity.

The present invention, therefore, provides a system that has such an effect on the plastics materials that they can be used in the three classes of explosive mixtures referred to above. Moreover, it is possible to produce shielding properties in plastics with the aid of this reinforcement material.

An important advantage of the invention is that, using a plurality of layers of such a carrier material, a laminate of sufficiently low continuity resistivity and volume resistivity can be formed. Surprisingly, it has been found that the comparatively small quantity of conductive fibres which has been passed through the carrier material gives sufficient conductivity to the laminate. This applies not only when the layers of the carrier material have been arranged in such a manner that the "bottom side", i.e., the side with few conductive fibres is in contact with the conductive web, but also when two 'bottom sides' have been positioned against each other.

The conductive fibre web to be used is a web of conductive fibres. Examples include webs of metallized fibres, metal fibres, or of fibres which have been provided with conductive additives. If the fibre web consists partly or wholly of metal fibres, the metals for the fibres may have been chosen from the conductive metals and alloys thereof. Examples of suitable metals are steel, copper and nickle. When using metallized fibres, it is preferred to use fibres which have been metallized with nickle, copper or silver, with alloys based on one or more of these metals, or consecutively with two or more of these metals. A suitable type of fibre is an acrylic fibre which has been metallized first with copper and then with nickle.

The conductive fibre web may consist exclusively of conductive fibres, but it is also possible to use a combination of conductive and non-conductive fibres in the web. For a good conductivity to be obtained, the length of the conductive fibres is preferably 40–70 mm. The web can be bonded thermally, chemically or mechanically. If so desired, it is also possible to use a woven or knitted fabric. The amount of conductive fibres must be sufficient for providing the desired conductivity. This can be determined by means of simple experiments. Generally, the amount of conductive fibres in the fibre web will be between 5 and 100 wt. %. Preferably, this amount is 5–25 wt. %.

As a carrier material according to the invention, all kinds of materials can be used. The carrier material may or may not be a reinforcing carrier material. It is also possible to use a core material as a carrier material. Such a core material generally does not have a reinforcing function, although it is possible to use a reinforcing core material. Finally, it is observed that it is also possible for a carrier material, which may or may not be reinforcing, having a conductive web provided thereon, to be combined with a core material that may or may not be reinforcing.

According to the invention, all kinds of materials can be used as carrier materials. Examples of such carrier materials include foam plastics, honeycomb materials, foils which may or may not be perforated, and in particular fibre webs which may or may not be woven.

Examples of carrier materials which are preferably used are glass mats, glass wovens, carbon wovens, woven fabrics, knitted fabrics and mats of other types of fibres such as aromatic polyamide.

Core materials such as fibre webs which have been provided with expanded microbeads can also be advantageously rendered electrically conductive in accordance with the invention.

The conductive properties are achieved by providing the carrier material with conductive fibres which are placed/strewn onto the carrier material (reinforcement material). The conductive fibres preferably have an aspect ratio of 500 or more. Typically, it will be in the neighbourhood of 4000–5000. A practical method with an even fibre distribution is for instance a card web. The fibre mat is subsequently anchored mechanically in and by the reinforcement material. This mechanical anchoring can for instance be obtained using needle machines or hydro-entanglement installations. The reinforcement could also be rendered electrically conductive by stitching electrically conductive yarns/wires/filaments through the reinforcement material. All anchoring methods whereby conductive fibres extend vertically through the reinforcement material are suitable. It is also possible to use a knitting or weaving technique, whereby a so-called two-and-a-half or three-dimensional knitted or woven fabric is obtained, provided that in the vertical direction an electrically conductive wire or yarn is used.

The formation of the conductive web can be realized by all known techniques for making a fibre web, more particularly a non-woven. By mixing the conductive fibres with other fibres, substantially any desired low dose can be distributed evenly and set accurately.

By stacking the conductive webs so obtained, as is conventional in the production of plastics laminates, a material is formed which is conductive through and through (volume conductivity). This is a property which is required for the use of these materials in mining, for instance.

It is observed that by providing the reinforcement material which has been rendered conductive exclusively in the top layer, it is possible to obtain only a surface conduction. In a number of cases this may be sufficient, while yet the advantage of the much simpler operation and handling of the assembly has been obtained. In fact, one of the advantages of the invention is that fewer operations are necessary for lamination and impregnation when using an assembly according to the invention. This is also advantageous for obtaining improved reproducibility of the properties of the final material.

It is possible to provide an electrically conductive layer at any desired point in the laminate. Placing the assembly with the conductive fibre web at the outside of a laminate moreover yields a smoother conductive surface of the laminate. The contour of the reinforcement material is compensated (cushioning effect). Inasmuch as only a small amount of (electrically conductive) fibres has been added to the reinforcement material, the processability (impregnation) of the reinforcement material and the mechanical properties of the final article are hardly, if at all, affected negatively.

The article according to the invention can be made from a thermoplastic or a thermosetting plastic. Examples of thermosetting plastics are phenol resins, epoxy resins, polyester resins and polyurethane resins. Thermoplasts which are eligible for use include the various 'engineering plastics' such as polypropene, ABS and related styrene polymers, polycarbonate, polyetherimide, polyphenylene oxide, polyphenylene sulfide and mixtures of these plastics. These plastics may also be reinforced with fibres.

The fibres to be used for the conductive fibre web, and also for the carrier material are, in particular, acrylic fibres, polyester fibres, glass fibres, carbon fibres and aramid fibres. Of course, the choice of the fibres is partly determined by the temperatures and the mechanical load which the material must be capable of resisting during manufacture and use.

The articles according to the invention can be made in different ways, depending on the materials to be used. In such systems, generally a closed mould is used. The assembly provided with the conductive fibre web or a combination of two or more of such assemblies is introduced into a mould, optionally with other materials which can serve as reinforcement of the plastics, for instance for making a fibre-reinforced laminate. Suitable methods for use within the framework of the present invention are resin transfer moulding (RTM), vacuum-injection, cold pressing, hand lay-up, spray-up, pulltrusion and GTM (Glass Mat Thermoplastics).

In RTM and vacuum-injection, a liquid resin, such as a thermosetting polyester resin, is injected into a closed mould in which are already placed one or more assemblies such as described hereinabove. Cold pressing is based on the same technique as RTM, with this difference that the resin is not injected but is pressed into the assembly during the closure of the mould.

Hand lay-up and spray-up are techniques in which the laminate is built up layer by layer (assembly and resin). In pulltrusion, the assembly, with resin added under pressure, is drawn through a die, followed by curing.

In GTM a fibre web, for instance a glass web, which has been impregnated with a thermoplastic resin, is deformed in a mould so as to form a laminate. The starting material may be one or more of such webs, in combination with at least one assembly according to the invention. However, it is also possible to deform in this manner an assembly which has been impregnated with a thermoplastic resin.

When working with a closed mould system, in combination with a liquid resin, it is preferable to provide the assembly to be used with wetters and/or breathers so as to improve the quality of the material surface. In this manner an air-bubble free smooth plastics surface can be obtained.

Finally, the invention also relates to an assembly consisting at least of a conductive fibre web which has been needled onto a glass mat.

The invention will hereinafter be illustrated in and by the following example, without being limited thereto.

EXAMPLE

On glass mats of about 450 g/m$^2$, a fibre web of about 50 g/m$^2$ was placed. This fibre web contained 10 wt. % of metallized (first coppered and then nickled) fibre and 90 wt. % of polyester fibre. Using a needling machine, this web was bonded to the corresponding glass mat. The metallized fibres accordingly extend through the two surfaces.

Using these glass mats provided with metallized fibre, a laminate was made (RTM).

Four layers (stacked, i.e., the conductive web against the glass mat) of this electrically conductive reinforcement material were processed into this laminate:

| | |
|---|---|
| Glass mat: | about 1800 g/m$^2$ (23.6%) |
| Fibre web: | about 200 g/m$^2$ (2.6%) |
| Polyester resin: | about 5630 g/m$^2$ (73.8%) |

Electrical and mechanical properties of this laminate which contains only 0.26 wt. % of metal fibre, are

| | |
|---|---|
| Surface resistivity: | ≦30 Ω# |
| Continuity resistivity: | 1.2 kΩ.cm |
| E-modulus: | 5890 N/mm$^2$ |
| Bending strength: | 141 N/mm$^2$ |

In tests where no conductive web was used, comparable values for E-modulus and bending strength were obtained. The electrical properties, however, were poor.

We claim:

1. Use of an assembly comprising at least one non-conductive or substantially non-conductive carrier material and at least one conductive fibre web which has been provided on at least one side of the carrier material, with fibres of the conductive web having been brought into electrically conductive contact, through the carrier material with the other side of the carrier material, the conductive fibres being present in an amount ranging from 5–100 weight % based upon the weight of the fibre web and having an aspect ratio of 500 or more, for making a reinforced plastics material.

2. Use according to claim 1, wherein the conductive web has been provided with metal fibres or with metallized fibres.

3. Use according to claim 2, wherein the fibres have been metallized with nickle, copper or silver, or with alloys based on one or more of these metals.

4. Use according to claim 1, wherein the carrier material has been selected from the group consisting of foam plastics, honeycomb material, foil which may or may not have been perforated and fibre web, such as a non-woven, a woven fabric or a knitted fabric.

5. Use according to claim 4, wherein the carrier material is a fibre web based on a material selected from the group consisting of glass fibres, polyester fibres, carbon fibres, aramid fibres, acrylic fibres and mixtures thereof.

6. Use according to claim 1, wherein the plastics material is made by impregnating the assembly with a liquid resin and a hardener therefor, followed by curing of the resin.

7. Use according to claim 6, wherein said resin has been selected from the group consisting of unsaturated polyester resin and epoxy resin.

8. A plastics article comprising a matrix resin, reinforced with an assembly comprising at least one non-conductive or substantially non-conductive carrier material and at least one conductive fibre web which has been provided on at least one side of the carrier material, with fibres of the conductive web having been brought into electrically conductive contact, through the carrier material, with the other side of the carrier material, the conductive fibres being present in an amount ranging from 5–100 weight % based upon the weight of the fibre web and having an aspect ration of 500 or more.

9. A plastics article according to claim 8, wherein the conductive web has been provided with metal fibres or with metallized fibres.

10. A plastics article according to claim 9, wherein the fibres have been metallized with nickle, copper or silver, or with alloys based on one or more of these metals.

11. A plastics article according to claim 8, wherein the carrier material has been selected from the group consisting of foam plastics, honeycomb material, foil which may or may not be perforated and fibre web, such as a non-woven, a woven fabric or a knitted fabric.

12. A plastics article according to claim 11, wherein the carrier material is a fibre web based on a material selected from the group consisting of glass fibres, polyester fibres, carbon fibres, aramid fibres, acrylic fibres and mixtures thereof.

13. A plastics article according to claim 8, wherein the plastics material has been made by impregnating the assembly with a liquid resin and a hardener therefor, followed by curing of the resin.

14. A plastics article according to claim 13, wherein said resin has been selected from the group consisting of unsaturated polyester resin and epoxy resin.

15. An assembly consisting of at least a conductive fibre web which has been needled onto a glass mat, said web having conductive fibres and wherein the conductive fibres have been metallized with nickel, copper or silver or with alloys based on one or more of these metals.

16. A plastics article in accordance with claim 13 wherein the carrier material comprises a plurality of layers in the form of a laminate evidencing low continuity resistivity and volume resistivity.

* * * * *